US009482494B1

(12) United States Patent
Lombardo et al.

(10) Patent No.: US 9,482,494 B1
(45) Date of Patent: Nov. 1, 2016

(54) BULLET RESISTANT SHIELD FOR ELECTRIC POWER EQUIPMENT

(71) Applicants: David Lombardo, Hampton, GA (US); Scott White, Hampton, GA (US); Samuel Harmon, Hampton, GA (US); Joseph R. Rostron, Hampton, GA (US)

(72) Inventors: David Lombardo, Hampton, GA (US); Scott White, Hampton, GA (US); Samuel Harmon, Hampton, GA (US); Joseph R. Rostron, Hampton, GA (US)

(73) Assignee: Southern States, LLC, Hampton, GA (US)

( * ) Notice: Subject to any disclaimer, the term of this patent is extended or adjusted under 35 U.S.C. 154(b) by 0 days.

(21) Appl. No.: 14/736,980

(22) Filed: Jun. 11, 2015

(51) Int. Cl.
*F41H 5/24* (2006.01)

(52) U.S. Cl.
CPC ..... *F41H 5/24* (2013.01)

(58) Field of Classification Search
CPC ..... F41H 5/24
USPC ..... 89/36.01, 36.02, 36.04
See application file for complete search history.

(56) References Cited

U.S. PATENT DOCUMENTS 1,547,841 A * 7/1925 Stevens ..... F41H 5/24 109/9
2,641,032 A * 6/1953 Freeman ..... E04F 10/08 52/466
2,788,550 A * 4/1957 Andrews ..... E04F 10/08 52/309.13
3,415,026 A * 12/1968 Tillisch ..... E04B 1/04 52/241
4,233,963 A * 11/1980 Werner ..... F24J 2/0488 126/628
4,452,230 A * 6/1984 Nelson ..... E04B 1/74 126/594
5,050,363 A * 9/1991 Fornell ..... E06B 5/106 109/58
6,111,189 A * 8/2000 Garvison ..... F24J 2/5211 126/621
7,159,503 B1 * 1/2007 Weatherwax ..... F41H 5/06 86/50
7,174,851 B2 * 2/2007 Bonner ..... A01K 1/0035 119/416
7,281,561 B2 * 10/2007 Anderson ..... E06B 9/264 160/121.1

(Continued)

*Primary Examiner* — Troy Chambers
*Assistant Examiner* — Bridget Cochran
(74) *Attorney, Agent, or Firm* — Mehrman Law Office; Michael J. Mehrman

(57) ABSTRACT

A bullet resistant shield for electric power equipment constructed from standardized modular sections configured for easy erection in the field into walls and enclosures. The modular sections may be constructed at a factory and transported to the desired location where the sections are assembled together into walls and enclosures. The modules are sized for transportation by trucks over public roadway, rail, barge and so forth. Concrete foundations may be installed prior to arrival of the modular sections to ready the site for erection of the shied structure upon arrival of the modular sections. Unlike conventional bullet resistant enclosures, these sections provide adequate ventilation to avoid overheating of air-cooled electric power equipment, such as large substation transformers. One or more electric fans may be mounted in the section to provide forced air ventilation. The wall may be positioned to allow walk-up maintenance access without the use of doors.

20 Claims, 9 Drawing Sheets

(56) References Cited

U.S. PATENT DOCUMENTS 7,724,518 B1 * 5/2010 Carlson ..... G06F 1/189 165/104.33
7,934,444 B2 * 5/2011 Carberry ..... E04H 9/10 109/49.5
8,869,673 B2 * 10/2014 Townsend ..... B64C 1/20 89/36.01
8,875,613 B2 * 11/2014 O'Neal ..... 273/403
2003/0084627 A1 * 5/2003 Bonin ..... E04B 1/7069 52/220.1
2005/0193663 A1 * 9/2005 Lombardo ..... E01C 5/005 52/279
2006/0213360 A1 * 9/2006 Ravid ..... F41H 5/013 89/36.01
2006/0234069 A1 * 10/2006 Sovine ..... E04B 9/00 428/457
2007/0180981 A1 * 8/2007 Tapp ..... F41H 5/013 89/36.02
2008/0271652 A1 * 11/2008 White ..... E01F 13/12 109/49.5
2010/0229715 A1 * 9/2010 Tonyan ..... F41H 5/0428 89/36.02
2010/0282062 A1 * 11/2010 Sane ..... F41H 5/007 89/36.02
2011/0048292 A1 * 3/2011 Zimmer, II ..... E05G 1/026 109/64
2011/0272319 A1 * 11/2011 Koivuluoma ..... F41H 5/0492 206/521
2012/0174759 A1 * 7/2012 Gallo ..... F41A 17/06 89/36.02
2012/0174763 A1 * 7/2012 Ritchie ..... E04H 9/10 89/36.04
2012/0186433 A1 * 7/2012 Braiewa ..... B32B 5/18 89/36.02
2012/0260792 A1 * 10/2012 Grossman ..... F41H 5/0478 89/36.02
2013/0233163 A1 * 9/2013 Bergiadis ..... F41H 5/013 89/36.02
2013/0233164 A1 * 9/2013 Kestermont ..... E04B 1/10 89/36.04
2014/0150636 A1 * 6/2014 Baron, Sr. ..... F41H 5/0457 89/36.02
2015/0168106 A1 * 6/2015 Pyles ..... F41H 5/0457 89/36.02
2015/0268005 A1 * 9/2015 Keren ..... F41H 5/026 89/36.02
2015/0308791 A1 * 10/2015 Navarra ..... F41H 5/24 89/36.02
2015/0308792 A1 * 10/2015 Tyler ..... F41H 5/24 89/36.02
2015/0354926 A1 * 12/2015 Gibson ..... F41H 5/24 89/36.04

* cited by examiner

| Ballistic Rating | Thickness | Panel Size | Nominal Weight (lbs) |
|---|---|---|---|
| **UL 752 - LEVEL 1** | .256" (1/4") | 36" x 84" | 57 |
| 9 mm full metal copper jacket with lead core | | 36" X 96" | 65 |
| 124 grain | | 36" x 108" | 73 |
| 8.0 (g) | | 36" x 120" | 81 |
| 1,175 fps velocity | | 48" x 96"<br>48" x 108"<br>48" x 120" | 85<br>97<br>108 |

| Ballistic Rating | Thickness | Panel Size | Nominal Weight (lbs) |
|---|---|---|---|
| **UL 752 - LEVEL 2** | .384" (3/8") | 36" x 84" | 84 |
| .357 Magnum jacketed lead soft point | | 36" X 96" | 96 |
| 158 grain | | 36" x 108" | 108 |
| 10.2 (g) | | 36" x 120" | 120 |
| 1,250 fps velocity | | 48" x 96"<br>48" x 108"<br>48" x 120" | 128<br>144<br>160 |

| Ballistic Rating | Thickness | Panel Size | Nominal Weight (lbs) |
|---|---|---|---|
| **UL 752 - LEVEL 3** | .512" (1/2") | 36" x 96" | 130 |
| .44 Magnum lead semi-wadcutter gas checked | | 36" X 108" | 146 |
| 240 grain | | 36" x 120" | 165 |
| 15.6 (g) | | 48" x 96" | 173 |
| 1,350 fps velocity | | 48" x 108"<br>48" x 120" | 194<br>216 |

*FIG. 10*

BULLET RESISTANT SHIELD FOR ELECTRIC POWER EQUIPMENT

TECHNICAL FIELD

The present invention relates to bullet resistant shielding and, more particularly, to bullet resistant shields for electric power equipment.

BACKGROUND

Terrorism, vandalism, war and firearms accidents can expose electric power equipment to gunfire. Electric power transformers located in transmission and distribution substations can be particularly vulnerable because they are relatively large targets located in virtually every community. The transformers are typically air-cooled and filled with oil or gel that can escape if the casing is pierced by gunfire resulting overheating, failure and a potential fire hazard. A single substation outage can affect a large number of customers and take several days to repair. Current bullet resistant shields designed for military vehicles and structures do not provide adequate ventilation for electric power equipment. While basic ballistic coverings and panels are commercially available from a number of vendors, there are no systems currently available for conveniently assembling the coverings or panels into wall and enclosures at existing electric equipment locations. As a result, there is continuing need for improved bullet resistant shielding for electric power equipment.

SUMMARY

The present invention may be embodied in a modular bullet resistant shield for electric power equipment constructed from standardized, ventilated sections designed for easy erection in the field into walls and enclosures. Unlike conventional bullet resistant enclosures, these sections provide adequate ventilation to avoid overheating of air-cooled electric power equipment, such as large substation transformers.

It will be understood that additional techniques and structures for implementing particular embodiments of the invention and accomplishing the associated advantages will become apparent from the following detailed description of the embodiments and the appended drawings and claims.

BRIEF DESCRIPTION OF THE FIGURES

FIG. 10 is a ballistic rating chart for illustrative panel configurations.

DETAILED DESCRIPTION

Figure 1:
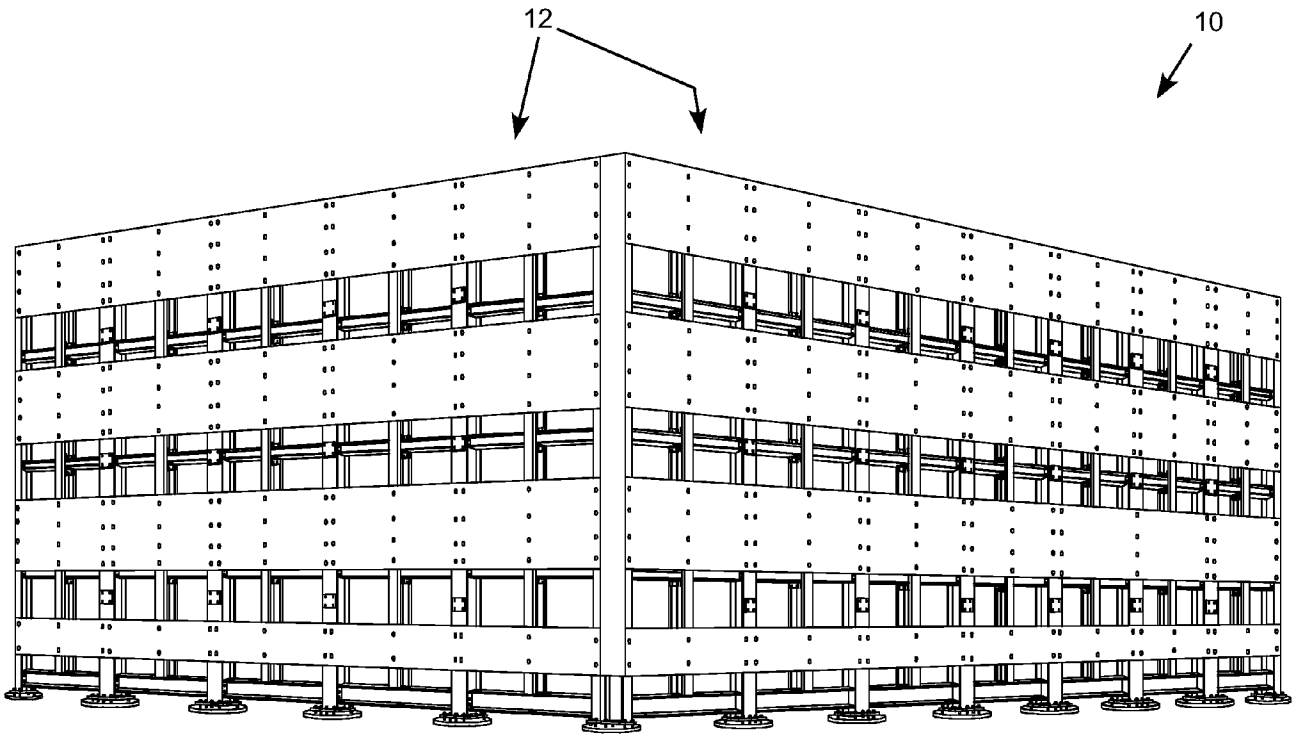
FIG. 1 is a perspective view of a bullet resistant enclosure shielding an electric power substation.

Embodiments of the invention may be realized in a bullet resistant shield for electric power equipment constructed from standardized modular sections configured for easy erection in the field into walls and enclosures. The modular sections may be constructed at a factory and transported to the desired location where the sections are assembled together into walls and enclosures. The modules are sized for transportation by trucks over public roadways, rail, barge and so forth. Concrete foundations may be installed prior to arrival of the modular sections to ready the site for erection of the shield structure upon arrival of the modular sections.

Unlike conventional bullet resistant enclosures, these utility grade sections provide adequate ventilation to avoid overheating of air-cooled electric power equipment, such as large substation transformers. The panels may include sufficient vertical overlap to prevent penetration of projectiles from vertical angles anticipated from a perpetrator intending to cause damage. The walls forming the enclosures may be placed to provide gunfire protection while allowing walk-up maintenance access without the use of doors or other movable entrance barriers. In an illustrative embodiment, ventilation is provided by mounting alternate panels on opposing sides of a galvanized steel frame. An uncovered portion at the bottom of the section may provide additional ventilation. One or more electric fans may also be mounted in the module to provide forced air ventilation. Clips provide attachment points for attaching sections together and eye hooks provide crane attachment points to facilitate assembly of sections into walls and enclosures in the field.

The panels, frames and sections are standardized for modular construction and to provide a common inventory for multiple structures. Standard panel heights are 36" and 48", and standard widths are 84", 96", 108" and 120" (corresponding to standard module widths). A typical 6-panel section utilizing 48"×120" panels is about 24 feet tall by 10 feet wide. The typical galvanized steel frame is an I-beam construction about one foot deep. Although galvanized steel is considered the best frame option for most locations in the United States, other types of frames, such as fiberglass, wood, composite or other suitable materials may be used as a matter of design choice. Typical beam spacing is 5 feet resulting in each 10-foot wide modular section having a beam on either end and in the center of the section. Horizontal beams may also be locate at approximately 5 foot intervals, typically with a horizontal beam at the top but not at the bottom of the section. The illustrative 10'×24' sections shown in the figures are approximately to scale. The panels may be attached to the frame with any suitable fasteners such as carriage bolts, rivets, rivet nuts or other fasteners.

The bullet resistant sections offer military grade protection for critical utility infrastructure facilities and equipment. Originally developed for use by the Department of Defense for protection from mortar fire, the ballistic panels offer superior bullet resistance and a significant weight advantage over commonly used products. The panels are constructed from multiple layers of woven fiberglass encapsulated with resin that produces a rigid panel with exceptional ballistic resistance. The unique composite matrix of the panels allow for retention of the projectile to avoid potentially hazardous ricochet. These protection products offer ballistic resistant security with the additional performance advantages of durability, corrosion resistance, electrical non-conductivity, low thermal conductivity and light weight (approximately 25% the weight of steel). Ballistic panels with United Laboratories (UL) 752 Standard for Bullet-Resisting Equipment ratings are available from a number of vendors including Armorco of Ashtabula, Ohio (armorco.com) and Gaffco® Ballistics (www.gaffco.com). The modular walls and enclosures also allow individual sections to be temporarily removed and replaced as needed. This allows the walls and enclosures be partially disassembled to the extent necessary to allow major maintenance, such as replacement of a transformer or other large piece of equipment, to allow crane or other vehicle access to the protected equipment, and so forth.

In an illustrative panel, the surface finish is smooth, off-white in color and suitable for painting with custom colors available in production quantities. Standard panels may be provided in a variety of sizes and thicknesses, with a nominal thicknesses options of ¼", ⅜" and ½" for protection to UL 752 Standard for Bullet-Resisting Equipment levels 1, 2 & 3, respectively, and National Institute for Justice (NW) Levels I, II & IIIA test standards, respectively. Additional levels of protection can be provided by layering these standard panels. The panels are particularly well suited for shielding electric power equipment because they are electrically non-conductive, thermally non-conductive, electromagnetically transparent, easily erected at typical substation locations, corrosion resistant, durable, and paintable allowing for custom colors. The panels are also non-ricochet as they retain projectiles and lightweight at approximately 25% the weight of steel.

FIGS. 1-9 show particular examples using standard 10'× 24' modular sections containing six panels connected to a steel frame (three front-side panels, and three back-side panels) providing ventilation through the modules. It will be appreciated that the number of panels in a module, the size of the panels, and the dimensions of the modular section may be changed as a matter or design choice. Panels of different sizes may also be combined in a module as a matter of design choice. The number of sections and the shape of particular walls and enclosures mays also be selected as a matter of design choice. Similarly, the deepness of the panels, color, shape, type of fasteners and other details may also be selected as a matter of design choice. A variety of standardized panels (e.g., different heights, different widths, etc.) may also be provided as desired.

FIG. 1 is a perspective view of a bullet resistant enclosure 10 (two walls 12 are shown) shielding an electric power substation. This particular enclosure is assembled from standard 10'×24' modular sections with five sections forming a first wall and seven sections forming the other wall. The nominal size of the enclosure is therefore 50'×70' and 24' tall. Depending on the site configuration and exposure to roads, shielding may be provided on one side (e.g., a single wall), on two sides as shown in FIG. 1 or on three or four sides.

Figure 2:
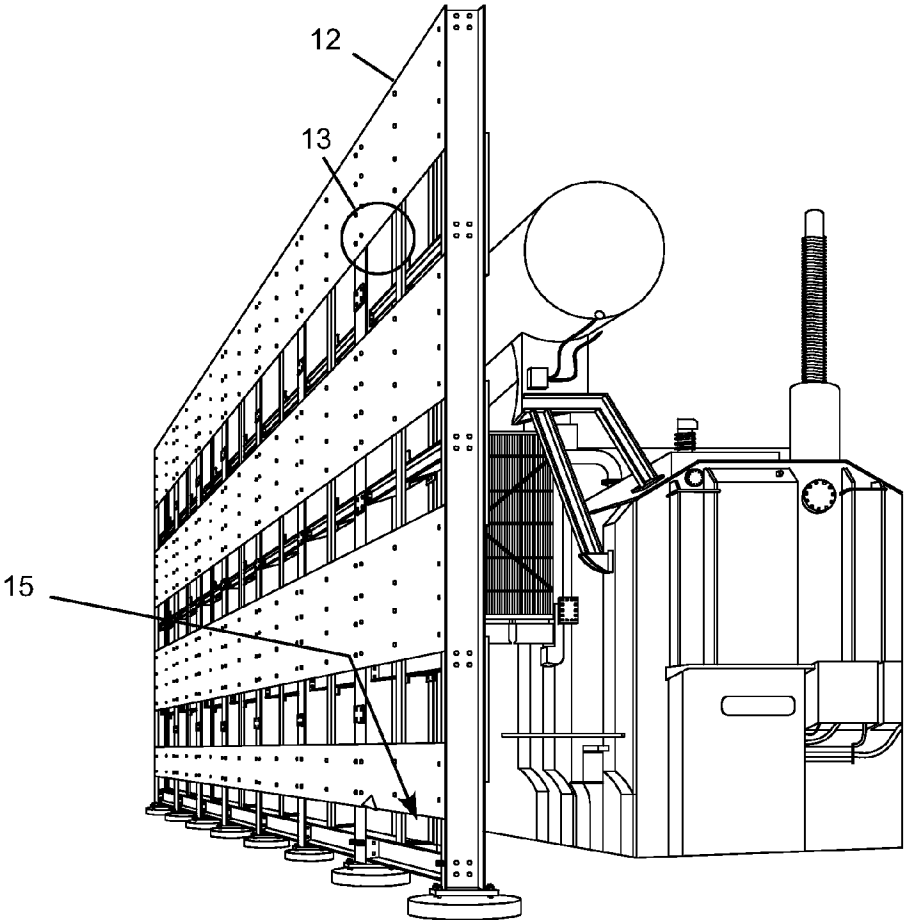
FIG. 2 is a perspective view of a bullet resistant wall shielding an electric power substation.

FIG. 2 is a perspective view of the bullet resistant wall 12 shielding an electric power substation. Alternating panels (from top to bottom) forming the wall are mounted on opposing sides of a steel frame providing ventilation through the wall. An illustrative passage 13 is labeled on the figure. There is also an uncovered section 15 at the bottom wall providing further ventilation. The uncovered bottom portion does not expose equipment to gunfire risk because only concrete foundations supporting the protected equipment are typically exposed at this level.

Figure 3:
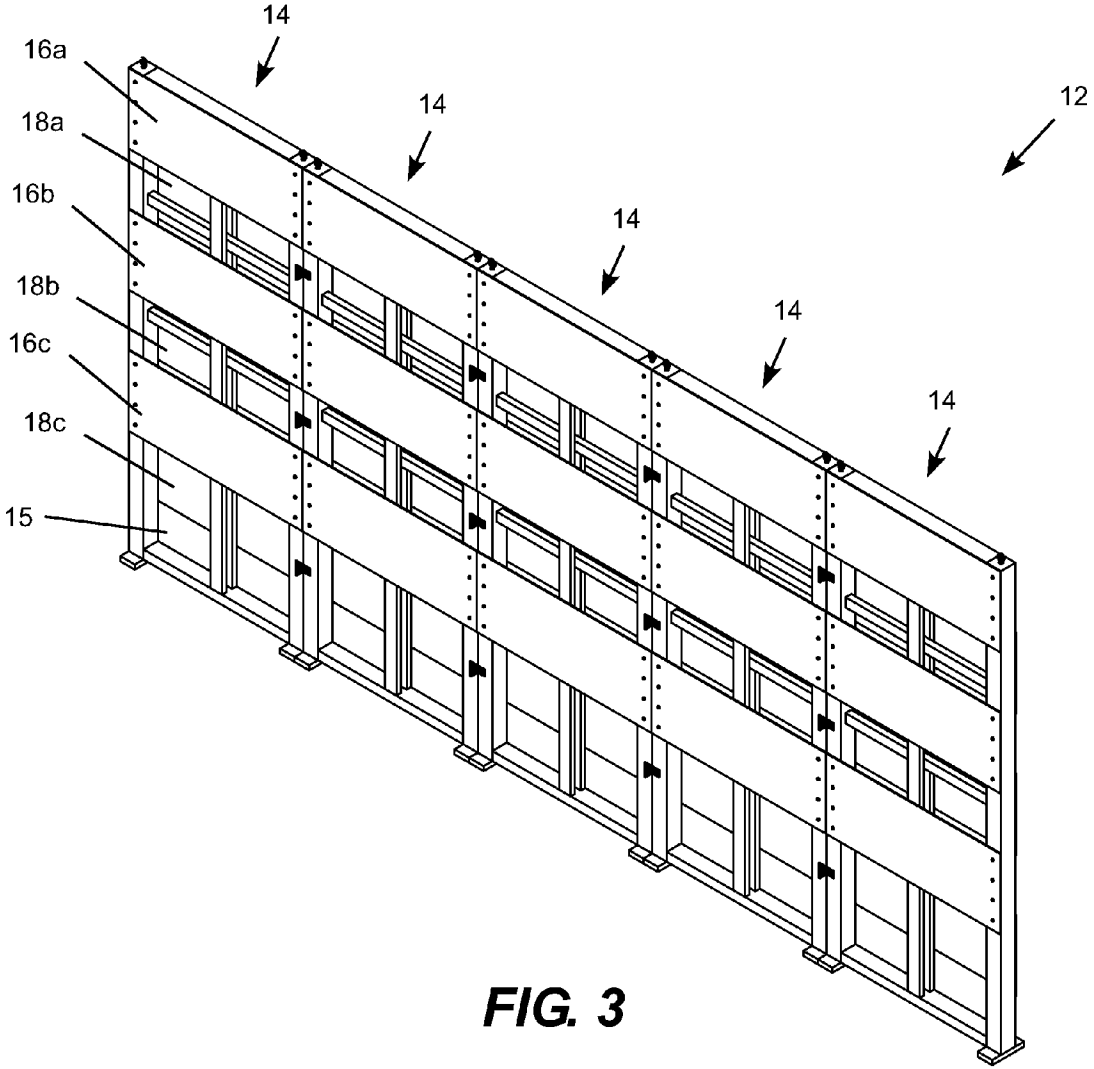
FIG. 3 is a perspective view of a modular bullet resistant wall for electric power equipment.
Figure 4:
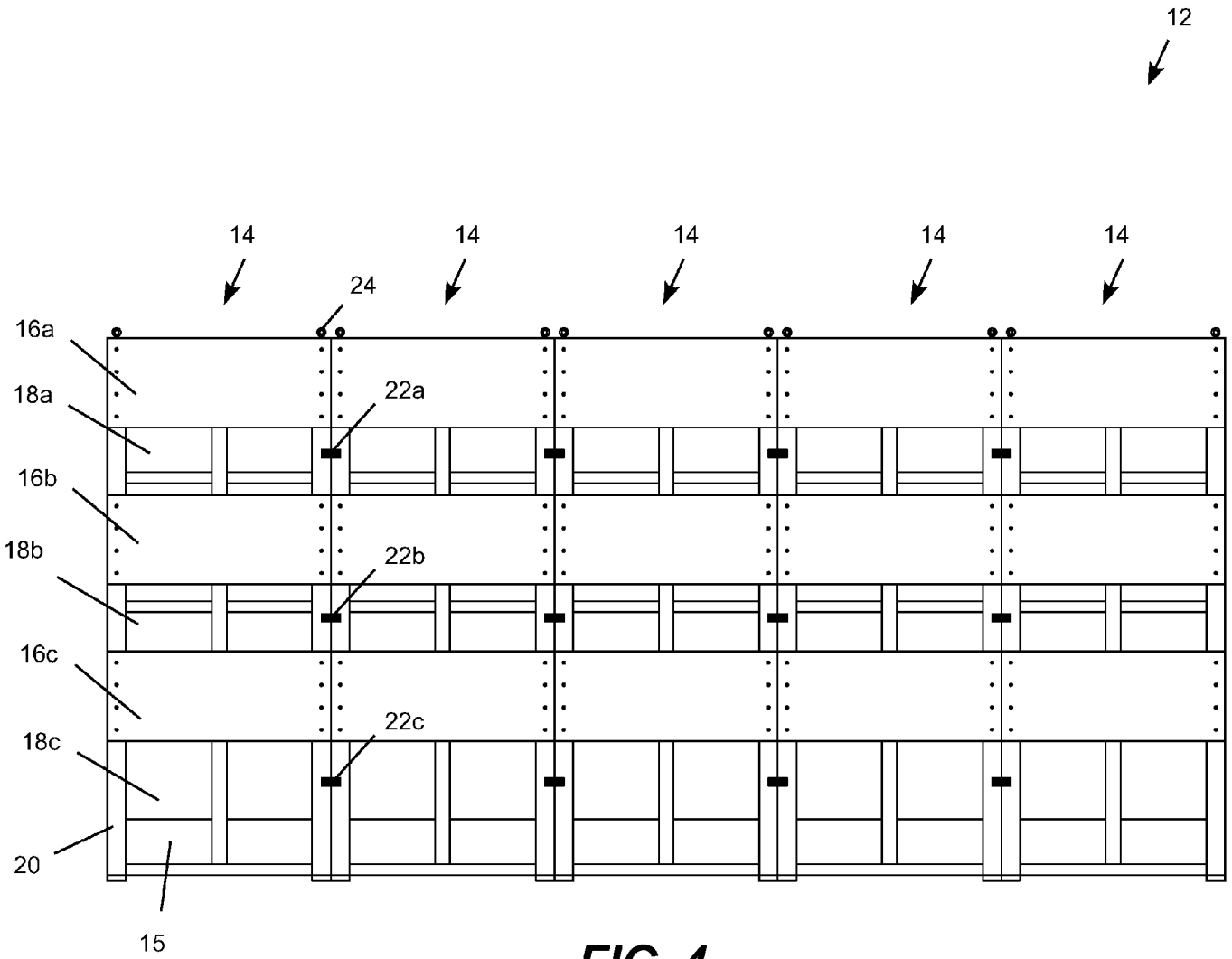
FIG. 4 is a front view of the modular bullet resistant wall.

FIG. 3 is a perspective view and FIG. 4 is a front view of a modular bullet resistant wall 12 for electric power equipment. The wall is formed from a number of modular sections 14 attached to a steel frame 20. The frame includes I-beam and cross beams typically at 5 foot intervals. Each section includes three bullet resistant front-side panels 16*a-c* attached to the front of the frame and three bullet resistant rear-side panels 18*a-c* attached the back of the frame. The panels are spaced apart without vertical overlap (or with a small vertically overlap to provide gunfire protection from likely gunfire angles while still providing adequate ventilation) to provide full coverage except for a 2' uncovered portion 15 at the bottom of the wall. Clips 22*a-c* attach adjacent panels together. Corner fasteners are also provided for attaching walls together at right angles and other desired connection angles. Eyes 24 on the top of the sections are provided for lifting the sections with a crane.

Figure 6:
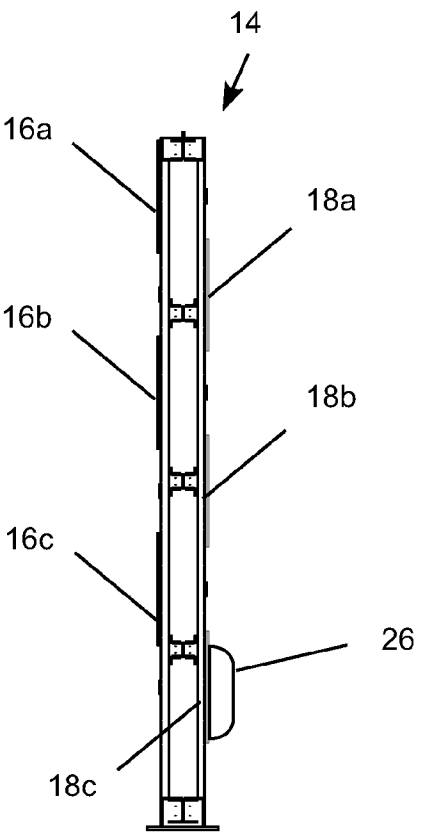
FIG. 6 is a side view of the modular bullet resistant section.
Figure 5:
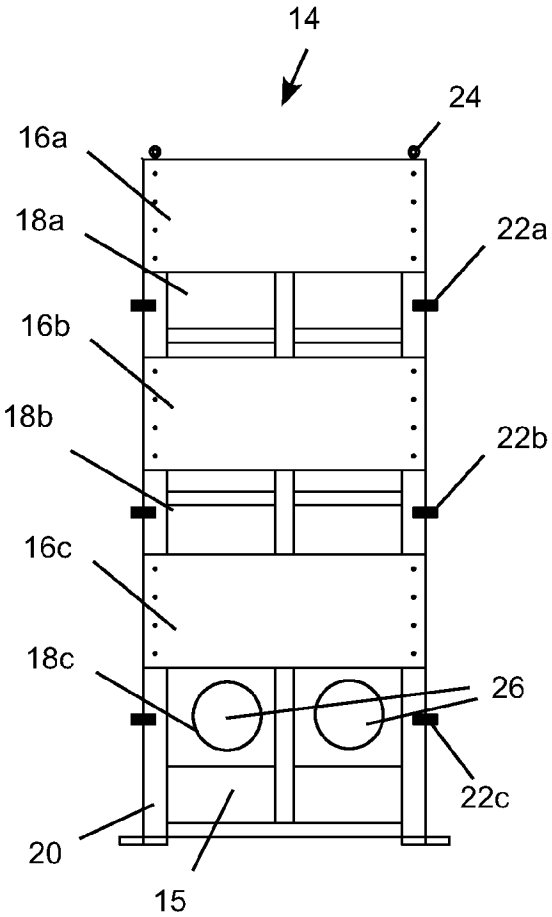
FIG. 5 is a front view of a modular bullet resistant section.

FIG. 5 is a front view and FIG. 6 is a side view of one module 14. This embodiment includes additional ventilation fans 26 to facilitate air cooling of the protected equipment. The fans are typically located in the bottom panels to facilitate an inward and upward air circulation pattern across the protected equipment. The type and capacity of the fans may be selected as a matter of design choice based on the needs of the protected equipment.

Figure 7:
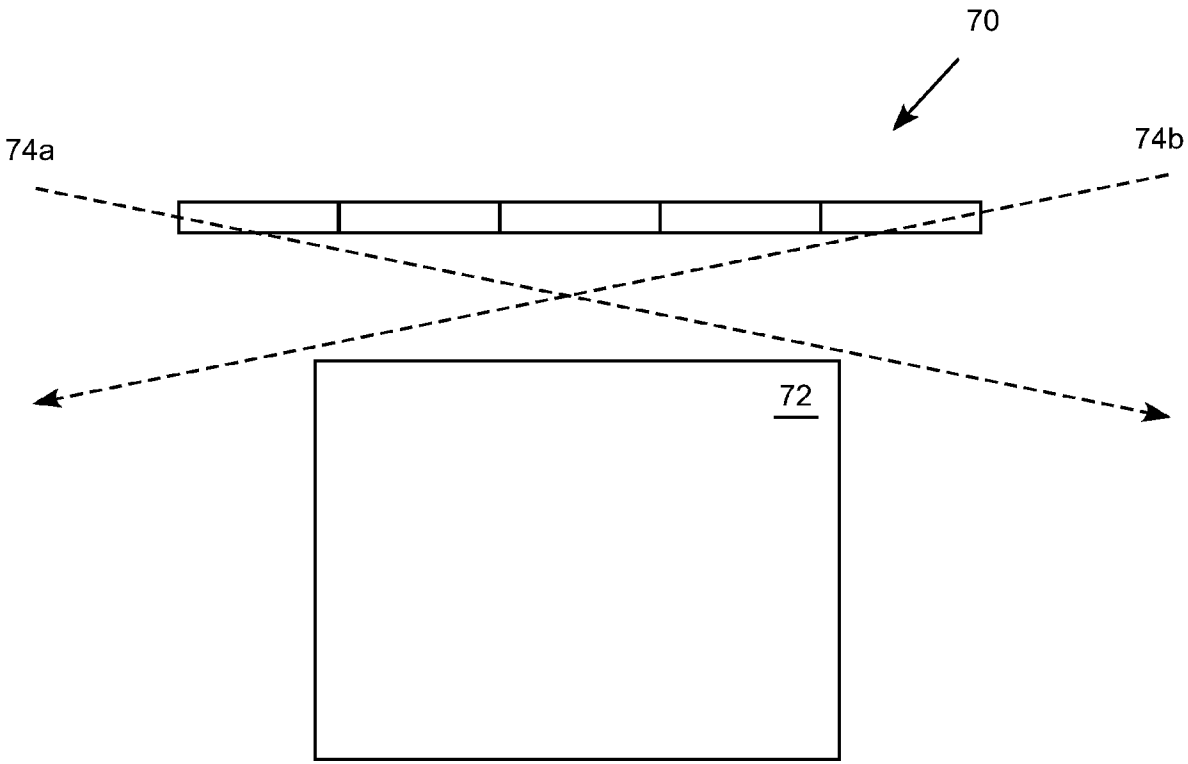
FIG. 7 is a conceptual illustration of a first bullet resistant shield configuration for protected equipment.
Figure 8:
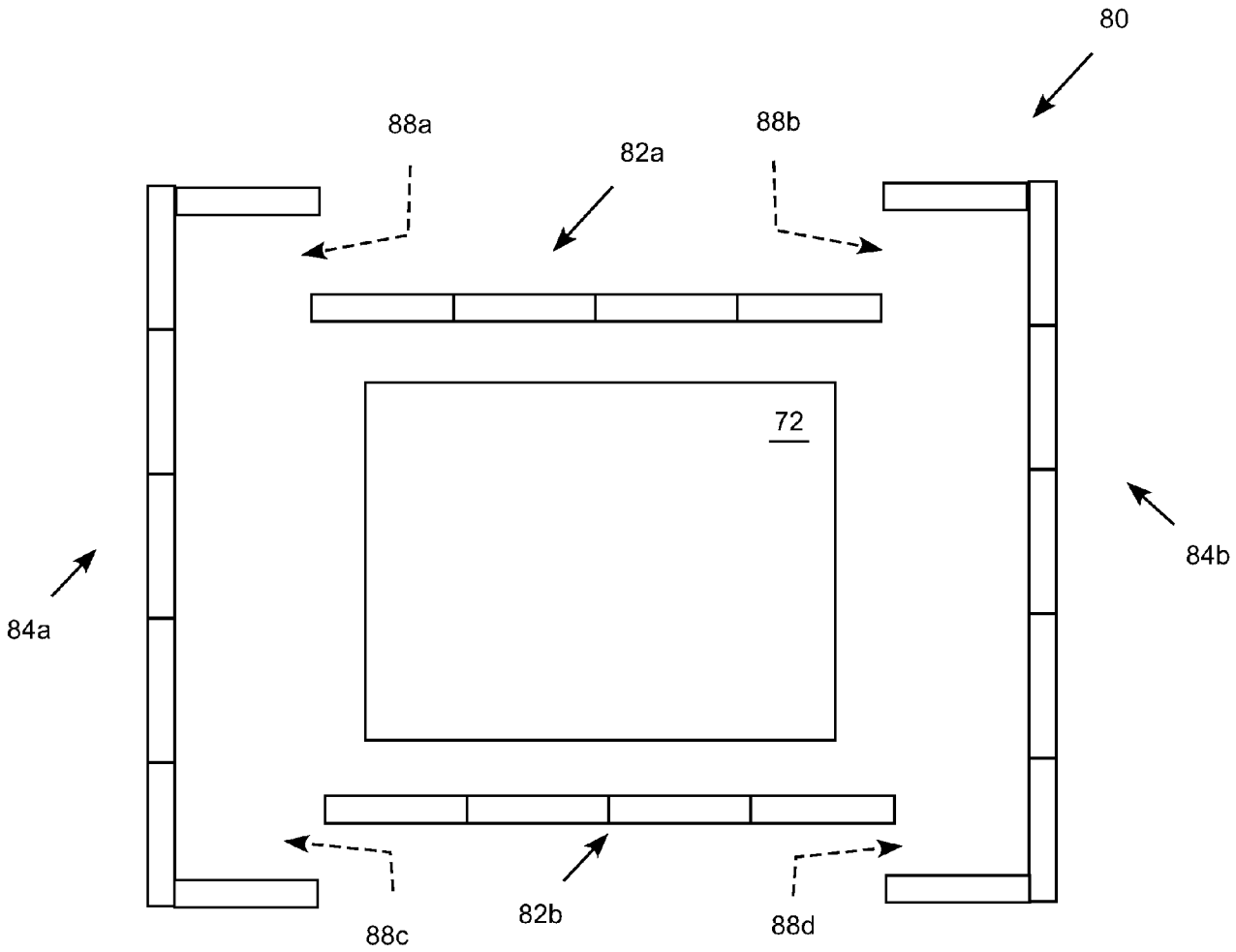
FIG. 8 is a conceptual illustration of a second bullet resistant shield configuration for protected equipment.
Figure 9:
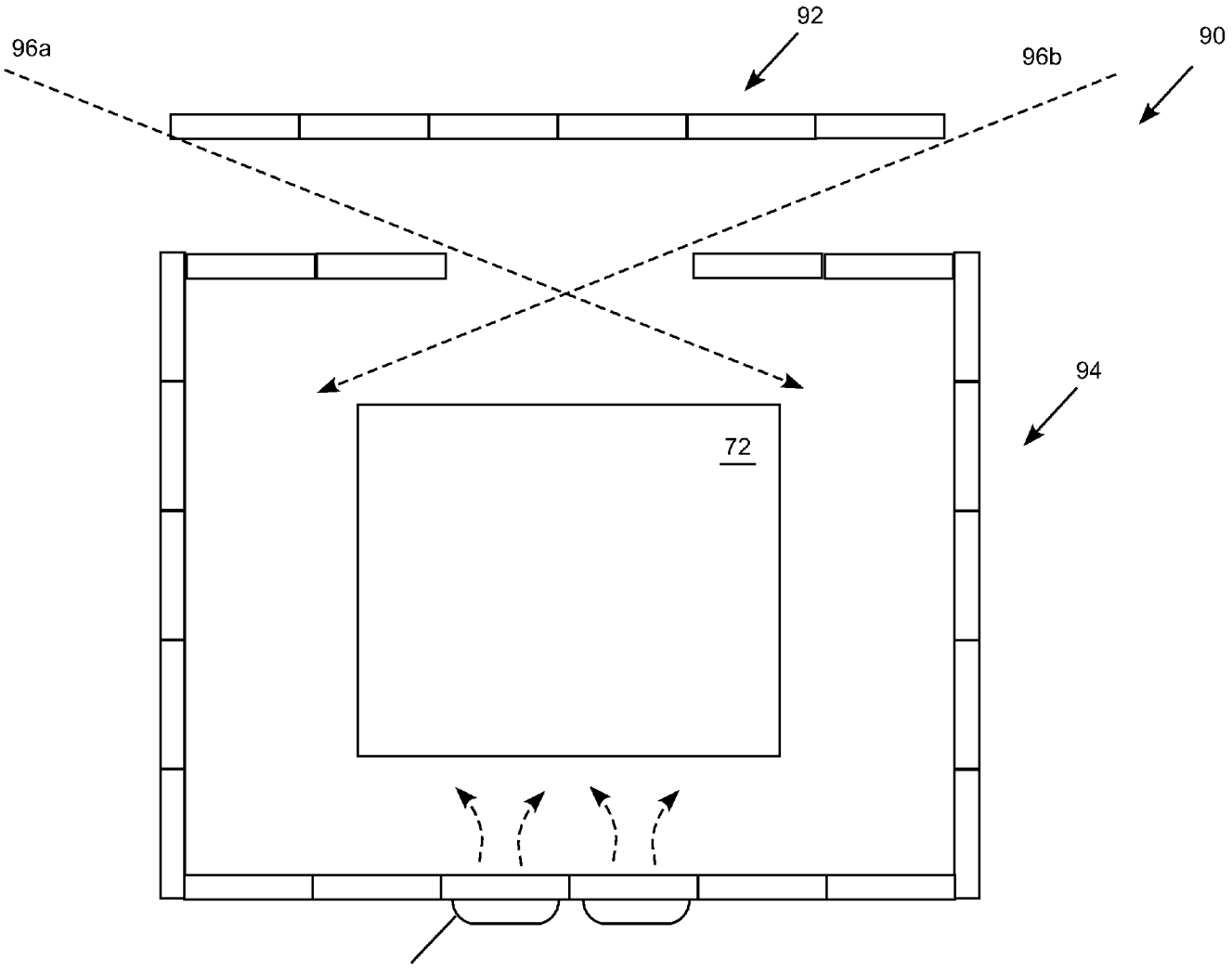
FIG. 9 is a conceptual illustration of a third bullet resistant shield configuration for protected equipment.

Many different protective wall and enclosure layouts may be designed to suit different site conditions, cost and protection objectives. FIGS. 7-9 illustrate a few basic design examples. FIG. 7 is a conceptual illustration of a first bullet resistant shield configuration for protected equipment 72. This configuration is a wall 70 sized and spaced apart from the protected equipment 72 sufficiently to allow walk-up maintenance access without the use of doors while protecting the equipment from available angles of attack 74*a-b* based on the site configuration. This shield configuration may be suitable for equipment located outside a building to provide protection from a roadway to one side of the equipment.

FIG. 8 is a conceptual illustration of a second bullet resistant shield configuration 80 for the protected equipment 72. This configuration includes inset side walls 82*a-b* and cornered end walls 84*a-b*. The walls are spaced apart to provide walk-up maintenance access openings 88*a-d*. This configuration provides full protection from all sides of the equipment to provide projectile protection while leaving physical openings to allow walk-up access for personnel without requiring a physical door that would otherwise be needed to provide to provide a full protection envelope.

FIG. 9 is a conceptual illustration of a third bullet resistant shield configuration 90 for protected equipment. This configuration includes an outer wall 92 in from of an enclosure 94 with a maintenance opening. This alternative also shows example placement of the ventilation fans 26.

FIG. 10 is a ballistic rating chart for illustrative panel configurations having nominal size, deepness and weight specifications.

In view of the foregoing, it will be appreciated that present invention provides significant improvements in bullet resistant shielding for electric power equipment. The foregoing relates only to the exemplary embodiments of the present invention, and that numerous changes may be made therein without departing from the spirit and scope of the invention as defined by the following claims.

The invention claimed is:

1. A bullet resistant shield for electric power equipment, comprising:

a plurality of similarly configured modules;

wherein each module includes a frame carrying a plurality of front-side panels forming a vertical front wall attached to a front side of the frame and a plurality of rear-side panels forming a vertical rear wall attached to a rear side of the frame, wherein the front wall is horizontally spaced apart from the rear wall, the front-side panels are spaced apart from each other forming one or more front-side openings, the rear-side panels are spaced apart from each other forming one or more rear-side openings, each front-side opening is horizontally aligned with a rear-side panel, and each rear-side opening is horizontally aligned with a front-side panel to provide ventilation through the module;

wherein multiple modules are connected to each other to form the shield; and wherein each panel is electrically non-conductive, thermally non-conductive, electromagnetically transparent, and has a bullet resistant characteristic meeting at least a United Laboratories (UL) 752 Level 1 Standard for Bullet-Resisting Equipment.

2. The bullet resistant shield of claim 1, wherein the frame comprises I-beams having a width of about one foot.

3. The bullet resistant shield of claim 1, wherein each module comprises three front-side panels and three rear-side panels, each panel having a width of about 10 feet and a height of about 2 feet.

4. The bullet resistant shield of claim 1, wherein each panel has a weight less than about 25% of a similarly sized steel panel.

5. The bullet resistant shield of claim 1, wherein each module comprises one or more eyes for lifting the module.

6. The bullet resistant shield of claim 1, wherein the panels have:

a deepness of about ¼ inches and a ballistic rating of UL752 Level 1;

a deepness of about ⅜ inches and a ballistic rating of UL752 Level 2; or a deepness of about ½ inches and a ballistic rating of UL752 Level 3.

7. The bullet resistant shield of claim 1, further comprising a ventilation fan disposed in a panel configured to direct cooling air onto equipment positioned adjacent to the shield.

8. The bullet resistant shield of claim 1, further comprising one or more opening for maintenance and wherein the bullet resistant shield comprises a plurality of sections position to provide gunfire protection while leaving physical openings to allow walk-up access for personnel without requiring a physical door.

9. A method for constructing a bullet resistant shield for electric power equipment, comprising:

manufacturing a plurality of similarly configured modules, wherein each module includes a frame carrying a plurality of front-side panels attached to a front side of the frame forming a vertical front wall, and a plurality of rear-side panels attached to a rear side of the frame forming a vertical rear wall, wherein the front wall is horizontally spaced apart from the rear wall, the front-side panels are spaced apart from each other forming one or more front-side openings, the rear-side panels are spaced apart from each other forming one or more rear-side openings, each front-side opening is horizontally aligned with a rear-side panel, and each rear-side opening is horizontally aligned with a front-side panel to provide ventilation through the module; and wherein each panel is electrically non-conductive, thermally non-conductive, electromagnetically transparent, and has a bullet resistant characteristic meeting at least a United Laboratories (UL) 752 Level 1 Standard for Bullet-Resisting Equipment;

transporting the modules to a location of electrical equipment to be protected; and effecting and attaching the modules to each other to create the bullet resistant shield in a position selected to protect the electrical equipment from gunfire.

10. The method of claim 9, wherein the frame comprises I-beams having a width of about one foot.

11. The method of claim 9, wherein each module comprises three front-side panels and three rear-side panels, each panel having a width of about 10 feet and a height of about 2 feet.

12. The method of claim 9, wherein each panel has a weight less than about 25% of a similarly sized steel panel.

13. The method of claim 9, wherein each module comprises one or more eyes for lifting the module.

14. The method of claim 9, wherein the panels have:

a deepness of about ¼ inches and a ballistic rating of UL752 Level 1;

a deepness of about ⅜ inches and a ballistic rating of UL752 Level 2; or a deepness of about ⅛ inches and a ballistic rating of UL752 Level 3.

15. The method of claim 9, further comprising a ventilation fan disposed in a panel configured to direct cooling air onto equipment positioned adjacent to the shield.

16. The bullet resistant shield of claim 9, further comprising one or more opening for maintenance and wherein the bullet resistant shield comprises a plurality of sections position to provide gunfire protection while leaving physical openings to allow walk-up access for personnel without requiring a physical door.

17. A bullet resistant shield for electric power equipment, comprising:

a frame carrying a plurality of front-side panels forming a vertical front wall attached to a front side of the frame and a plurality of rear-side panels forming a vertical rear wall attached to a rear side of the frame;

wherein the front wall is horizontally spaced apart from the rear wall, the front-side panels are spaced apart from each other forming one or more front-side openings, the rear-side panels are spaced apart from each other forming one or more rear-side openings, each front-side opening is horizontally aligned with a rear-side panel, and each rear-side opening is horizontally aligned with a front-side panel to provide ventilation through the shield; and wherein each panel is electrically non-conductive, thermally non-conductive, electromagnetically transparent, and has a bullet resistant characteristic meeting at least a United Laboratories (UL) 752 Level 1 Standard for Bullet-Resisting Equipment.

18. The bullet resistant shield of claim 17, wherein the frame comprises I-beams having a width of about one foot.

19. The bullet resistant shield of claim 17, wherein the panels have:

a deepness of about ¼ inches and a ballistic rating of UL752 Level 1;

a deepness of about ⅜ inches and a ballistic rating of UL752 Level 2; or a deepness of about ½ inches and a ballistic rating of UL752 Level 3.

20. The bullet resistant shield of claim 17, further comprising a ventilation fan disposed in a panel configured to direct cooling air onto equipment positioned adjacent to the shield.

* * * * *